US007032349B2

(12) United States Patent
Oberheide et al.

(10) Patent No.: US 7,032,349 B2
(45) Date of Patent: Apr. 25, 2006

(54) CORELESS MOTOR DOOR CLOSURE SYSTEM FOR MOTOR VEHICLES

(75) Inventors: G. Clark Oberheide, Troy, MI (US); Peter Lance Oxley, Mount Albert (CA); Mirko Pribisic, North York (CA); Dragan Mrkovic, Toronto (CA)

(73) Assignee: Atoma International Corp., Newmarket (CA)

( * ) Notice: Subject to any disclaimer, the term of this patent is extended or adjusted under 35 U.S.C. 154(b) by 101 days.

(21) Appl. No.: 10/258,644

(22) PCT Filed: Apr. 27, 2001

(86) PCT No.: PCT/CA01/00573

§ 371 (c)(1),
(2), (4) Date: Oct. 25, 2002

(87) PCT Pub. No.: WO01/83925

PCT Pub. Date: Nov. 8, 2001

(65) Prior Publication Data

US 2003/0089042 A1 May 15, 2003

Related U.S. Application Data

(60) Provisional application No. 60/199,965, filed on Apr. 27, 2000.

(51) Int. Cl.
*E05F 11/54* (2006.01)

(52) U.S. Cl. ..... 49/360

(58) Field of Classification Search ..... 49/360, 49/324, 352, 349

See application file for complete search history.

(56) References Cited

U.S. PATENT DOCUMENTS

| | | | | | |
|---|---|---|---|---|---|
| 3,403,474 | A | * | 10/1968 | Spasoff | 49/360 |
| 3,671,841 | A | * | 6/1972 | Hoffmann | 318/696 |
| 4,057,934 | A | * | 11/1977 | Okubo et al. | 49/28 |
| 4,231,190 | A | * | 11/1980 | Tieben | 49/25 |
| 4,887,390 | A | * | 12/1989 | Boyko et al. | 49/214 |
| 4,932,715 | A | * | 6/1990 | Kramer | 296/155 |
| RE33,628 | E | | 7/1991 | Hahn | |
| 5,168,666 | A | * | 12/1992 | Koura et al. | 49/360 |
| 5,551,190 | A | * | 9/1996 | Yamagishi et al. | 49/360 |
| 5,867,940 | A | * | 2/1999 | Watanaba et al. | 49/360 |
| 5,913,563 | A | * | 6/1999 | Watanabe et al. | 296/155 |
| 5,955,813 | A | * | 9/1999 | Bolte et al. | 310/254 |
| 5,979,114 | A | * | 11/1999 | Clark et al. | 49/360 |

(Continued)

FOREIGN PATENT DOCUMENTS

FR 2743106 7/1997

*Primary Examiner*—Gregory J. Strimbu
(74) *Attorney, Agent, or Firm*—Clark Hill PLC

(57) ABSTRACT

An automation assembly is adapted to be connected to a door system of a motor vehicle. The automation assembly is modular and includes a frame that is fixedly secured to the motor vehicle. A motor is fixedly secured to the frame and adapted to receive power. The motor converts the power into a rotational output force. The motor includes a non-ferrous core. A set of pulleys and rollers are fixedly secured to the frame at predetermined positions to direct the path of a continuous belt. The continuous belt is fixedly secured to the door system such that the motor moves the continuous belt and the door system bidirectionally between an open position and a closed position. Sensors are used to determine the position of the door, the speed thereof and whether the door is being moved manually.

5 Claims, 6 Drawing Sheets

U.S. PATENT DOCUMENTS 5,992,919 A * 11/1999 Menke ..... 296/155
6,038,818 A 3/2000 Haag et al.
6,125,586 A * 10/2000 Buscher ..... 49/360
6,179,742 B1 * 1/2001 Haag et al. ..... 475/154
6,198,242 B1 * 3/2001 Yokomori et al. ..... 318/445
6,629,905 B1 * 10/2003 Sesselmann et al. ..... 475/149

* cited by examiner

CORELESS MOTOR DOOR CLOSURE SYSTEM FOR MOTOR VEHICLES

This application claims the benefit of the Provisional Application No. 60/199,965, filed Apr. 27, 2000.

FIELD OF THE INVENTION

The invention relates to a system for moving a component part of a motor vehicle. In particular, the invention relates to an actuator used to selectively provide access to an enclosure of a motor vehicle.

DESCRIPTION OF THE RELATED ART

As motor vehicles characterized by their utility become a mainstream choice, consumers demand certain luxuries primarily associated with passenger cars, either due to their inherent design and/or size. One of the features desired by consumers is the automated movement of such items as sliding doors and lift gates. While features providing automated motion are available, the designs for mechanisms used to accommodate manual overrides are lacking in capability and functionality.

U.S. Pat. No. 5,144,769 discloses an automatic door operating system. This system requires a great deal of control, both by an electronic controller and an operator of the motor vehicle. To overcome forces due to manual operation, the manually operated seesaw switch used by the operator to electromechanically operate the door is in an open state, preventing current from passing through the motor. While this system may not generate a current, the iron core of the motor armature must move with respect thereto and this will create an inertial force and a magnetic loss that must be overcome. Further, there is no contemplation of overcoming the friction forces generated by the belt and transmission system that incorporates the use of the motor.

SUMMARY OF THE INVENTION

An automation assembly is adapted to be connected to a door system of a motor vehicle. The automation assembly includes a frame that is fixedly secured to the motor vehicle. A motor is fixedly secured to the frame and adapted to receive power. The motor converts the power into a rotational output force. The motor includes a non-ferrous core. A set of rollers are fixedly secured to the frame at predetermined positions. A continuous belt extends around the set of rollers and the motor. The belt is fixedly secured to the door system such that the motor moves the continuous belt and the door system bidirectionally between an open position and a closed position.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
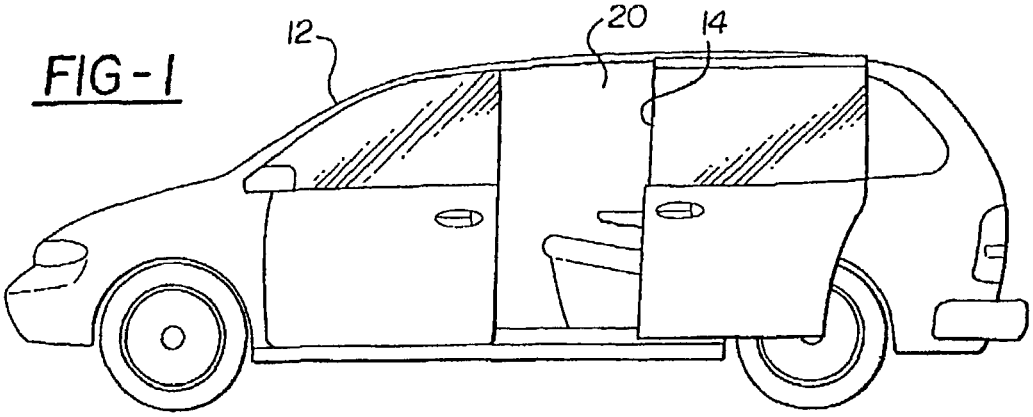
FIG. 1 is a side view of a motor vehicle with a sliding side door in its open position.

Referring to the Figures, wherein like primed reference characters represent similar elements through the different embodiments of the invention, the invention 10 is generally a closure assembly for a motor vehicle 12. Although the invention 10 will be described to be incorporated into and/or working in conjunction with a sliding door 14 of a minivan-styled motor vehicle 12, it should be appreciated by those skilled in the art that the invention 10 is not limited to this style closure and motor vehicle.

Figure 2:
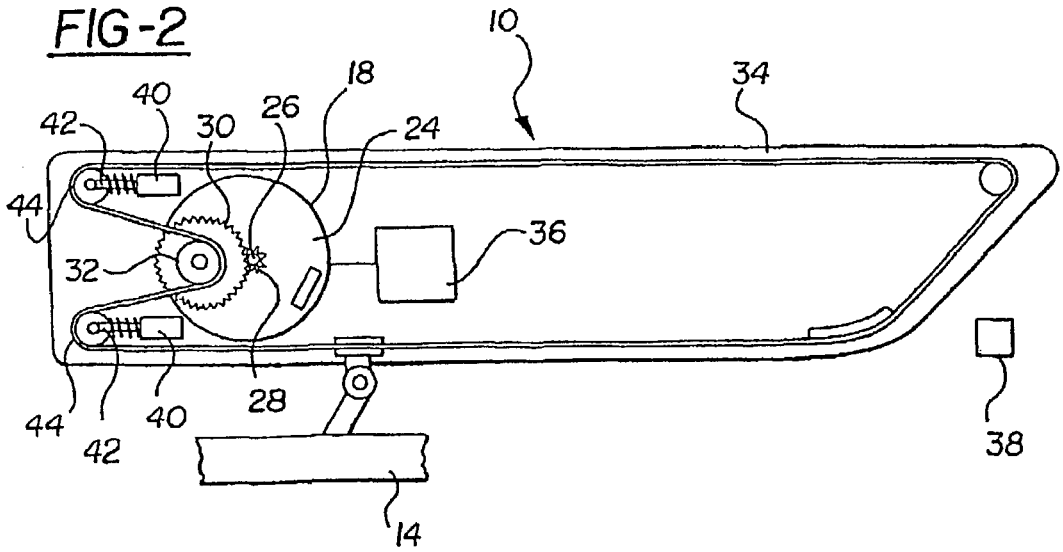
FIG. 2 is a top view of one embodiment of the invention.
Figure 3:
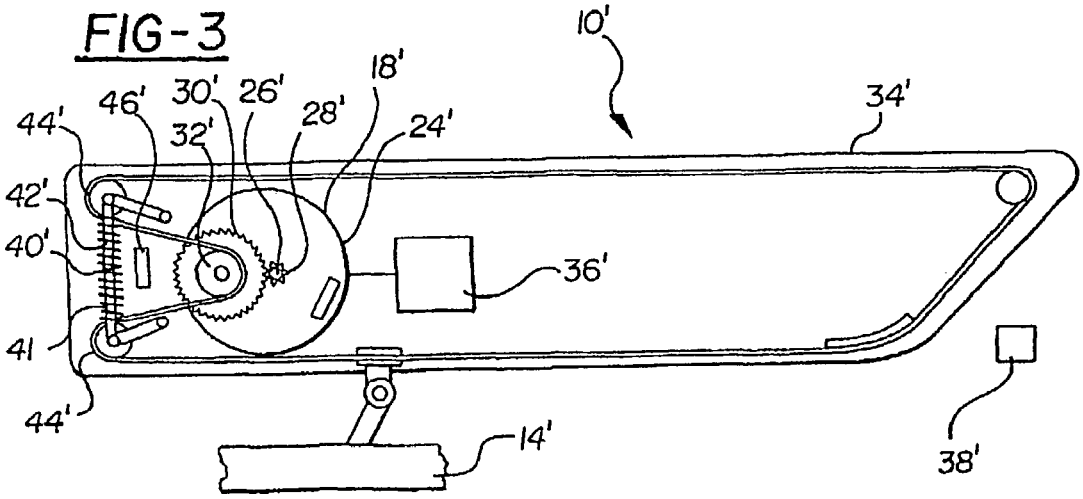
FIG. 3 is a top view of a second embodiment of the invention.

Referring to FIGS. 2 and 3, a coreless motor is generally indicated at 18. The coreless motor 18 is used in an assembly to automatically move the sliding door 14 with respect to a specific frame of reference, i.e., the door opening 20. The coreless motor 18 includes a housing 22 within which an ironless disk 24 is housed. Motor brushes (not shown) are connected to an electrical current via electrical leads (not shown). The disk 24 is secured to a motor output shaft 26. A pinion gear 28 is mounted to the motor output shaft 26 and rotates therewith.

The pinion gear 28 rotates the drive gear 30. The ratio of the pinion gear 28 with respect to the drive gear 30 is between 1:6 and 1:8. This allows the disk to have a smaller diameter than would otherwise be possible if the drive gear 30 was closer in diameter to the pinion gear 24. In the preferred embodiment, the disk 24 has a diameter of approximately 10 mm. A pulley 32 is secured to the drive gear 30 such that there is no lost motion therebetween. The pulley 32 drives a belt 34, discussed subsequently.

The coreless motor 18 is a direct current (DC) electrodynamic machine having its armature coil-turn windings (not shown) within the magnetic air-gap without using a ferrous material for a flux linkage. The absence of the ferrous core for flux linkage requires the diameter of the disk to be larger than would otherwise be needed. The coreless motor 18 does, however, generate less current when it is manually rotated in a direction opposite that in which the current flowing through the brushes would dictate. Likewise, less current is generated in the coreless motor 18 if the coreless motor 18 is not being operated. Therefore, a smaller force is needed to move the sliding door 14 manually without the aid of the automatic opening features. For a brush-commutated motor, the armature is the rotor and the field is the stator. For a brushless motor, the field rotates and the armature is the stator.

An electronic controller 36 controls the coreless motor 18. It does so by receiving inputs from a motor encoder sensor 38 that determines the position of the belt 34 and the sliding door 14 with respect to the motor vehicle 12.

Tensioning devices 40 are used to take up slack when the sliding door is moved manually. In the embodiment shown in FIG. 2, the tensioning devices 40 are pulleys 44 with spring loaded plungers 42. In the embodiment shown in FIG. 3, a compression spring 42' extends between the two pulleys 44'. A potentiometric sensor 46' is used to identify the amount of potential stored within the spring 42'. If the spring 42' is unbalanced, the electronic controller 36' operates the coreless motor 18' to return the spring 42' to balance.

The presence of a back-driving force may be sensed in the interfacing transmission, i.e., the pinion gear 28', the drive gear 30' and the pulley 32'. Once sensed, the information is in a manner similar to feedback wherein the information is transmitted back to the electronic controller 36' allowing it to then operate the coreless motor 18'. In this manner, the coreless motor 18' would be operated to keep up with the movement of the sliding door 14' eliminating the need for the operator to manually overcome the losses due to the coreless motor 18' and the interfacing transmission. Sensing such movement may be accomplished using the belt path shown in FIG. 3. This embodiment of the belt path includes a center spring 41 and the potentiometric sensor 46'. When the belt 34' is being forced one direction or another, the center spring 41 is unbalanced. This unbalance is sensed by the potentiometric sensor 46' and then transmitted to the electronic controller 36' which, in turn, operates the coreless motor 18' to attempt to return the center spring 41 to balance. Once the center spring 41 returns to steady state or balance, typically by the operator ceasing to move the sliding door 14', the electronic controller 36' stops the coreless motor 18'.

Figure 4:
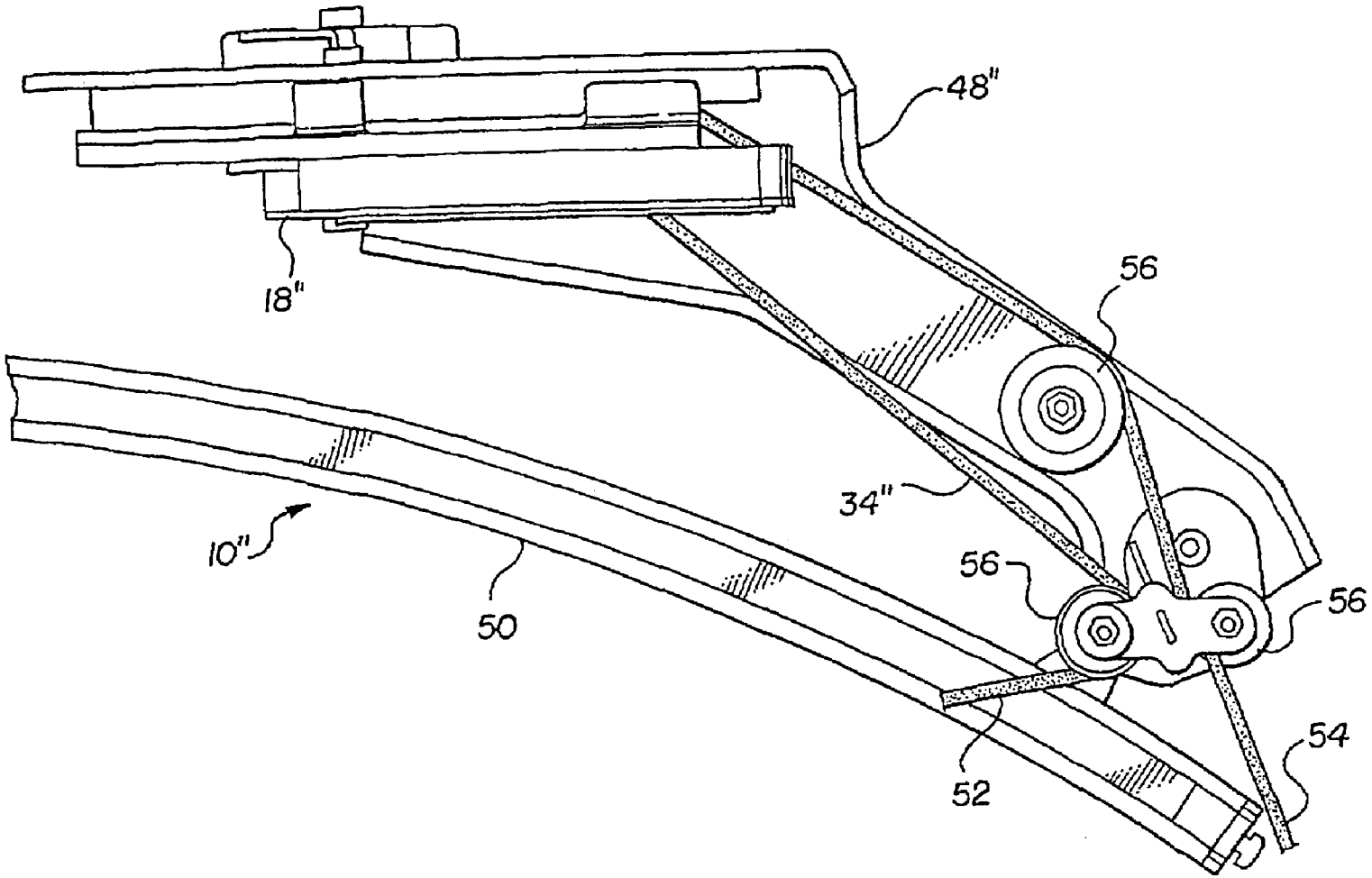
FIG. 4 is a top view, partially cut away, of a third embodiment of the invention.
Figure 5:
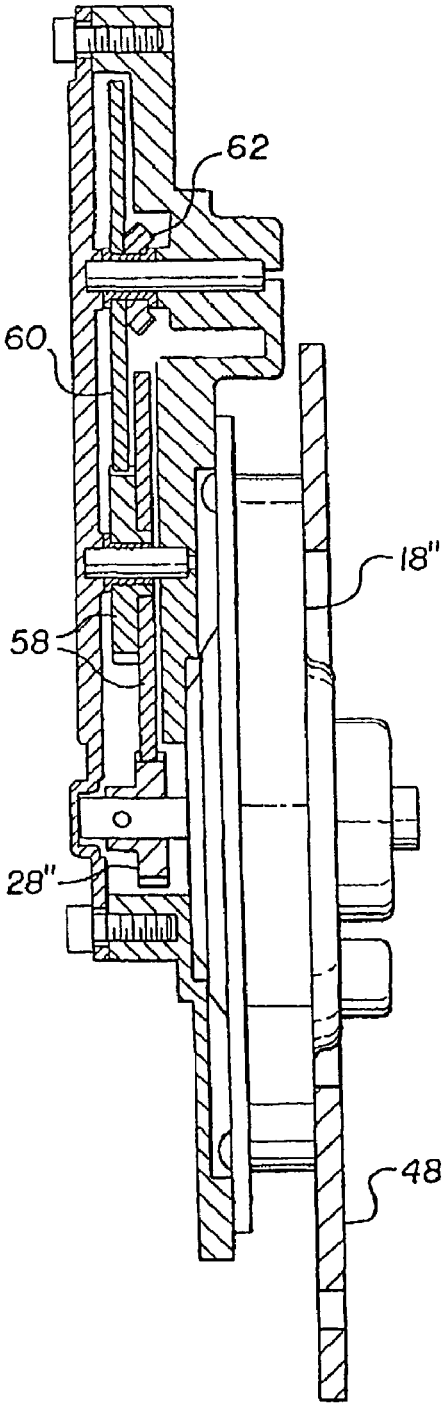
FIG. 5 is a cross-sectional side view of the frame and motor utilized by the third embodiment of the invention.
Figure 6:
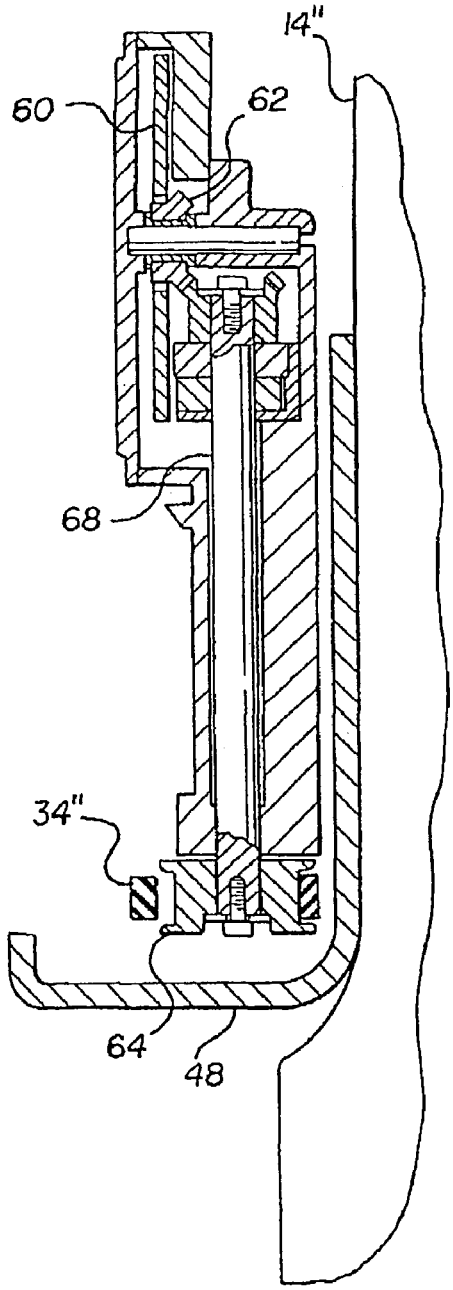
FIG. 6 is a cross-sectional side view of a portion of the frame in a track utilized by the third embodiment of the invention.
Figure 7:
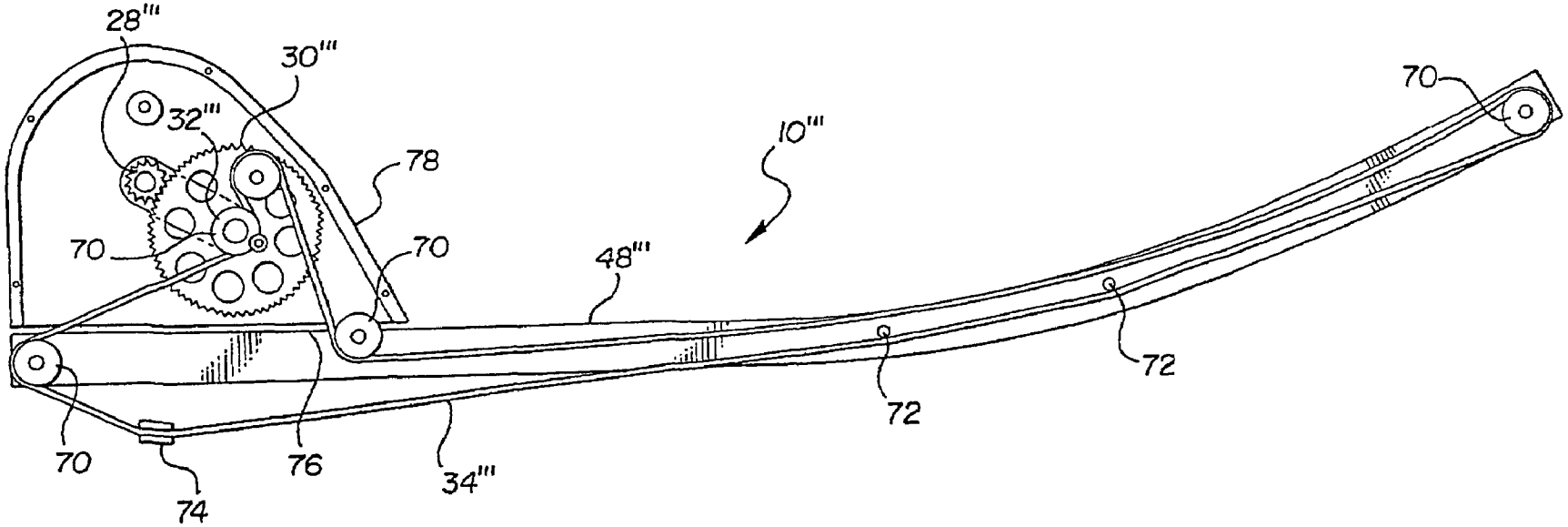
FIG. 7 is a top view of a fourth embodiment of the invention.
Figure 8:
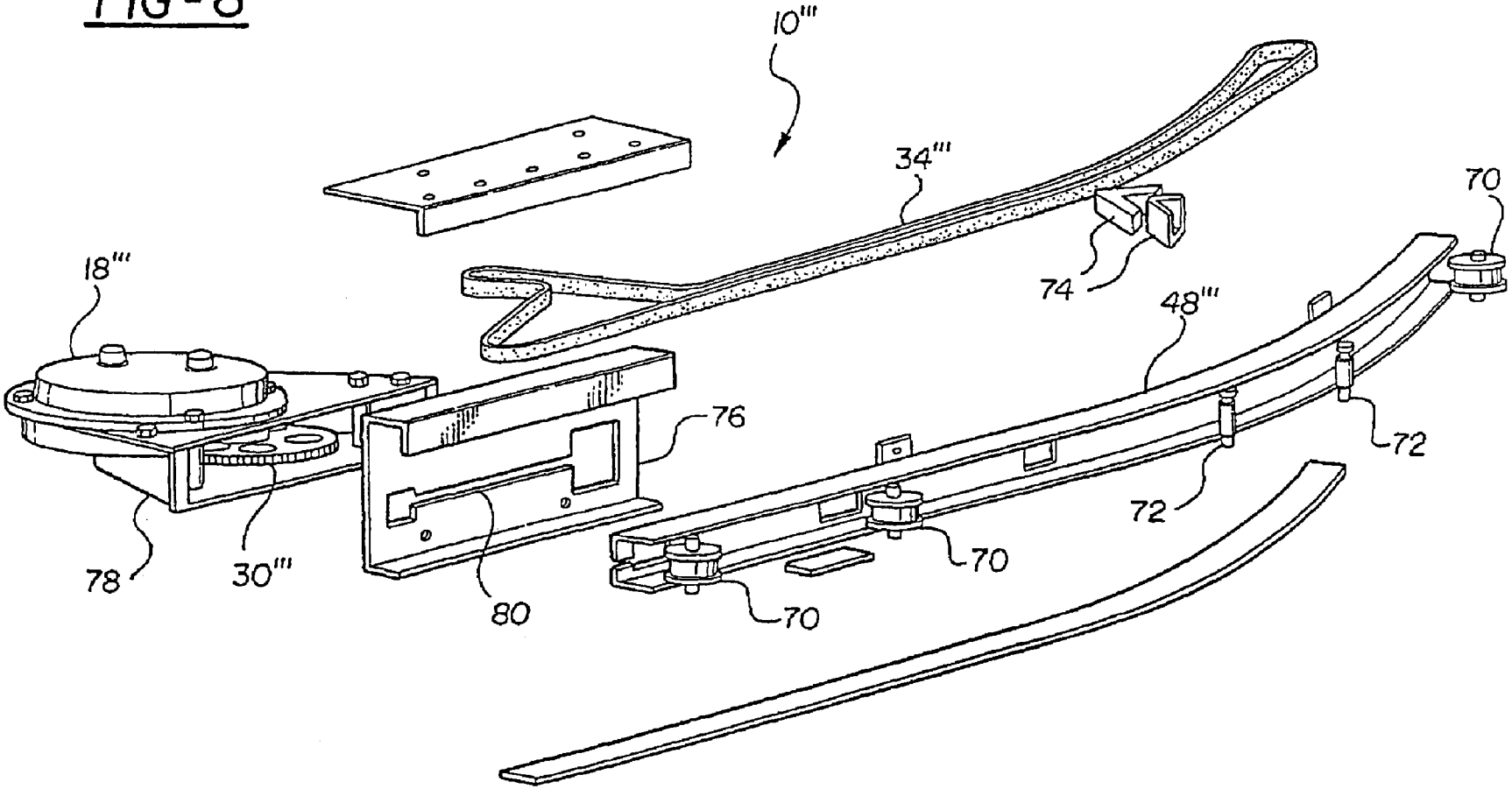
FIG. 8 is an exploded perspective view of the fourth embodiment of the invention.
Figure 9:
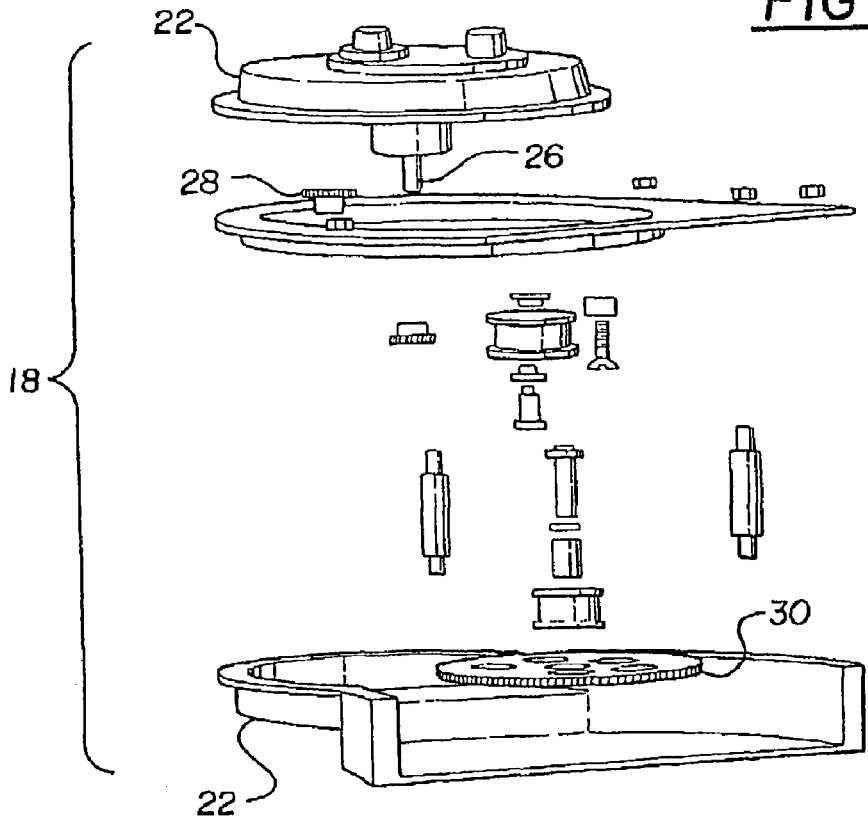
FIG. 9 is an exploded perspective view of the motor incorporated into the four embodiments of the invention.

Referring to FIGS. 4 through 6, a third embodiment of the invention 10" is shown. The invention is an automated assembly 10" adapted to operate the sliding door 14" of the motor vehicle. The automated assembly 10" includes a frame 48. The frame 48 is moveable with respect to a track 50 used by the sliding door 14" to move between the open and closed positions. The frame 48 slides along the track 50 using rollers (not shown).

The coreless motor 18" is fixedly secured to the frame 48. The coreless motor 18" moves the frame 48 by rotating its output shaft 26" to move a pulley (not shown). The pulley forces the frame 48 to move along the belt 34". The belt 34" in this embodiment is not continuous. The belt 34" extends along a curved path between a first end 52 and a second end, graphically represented at 54 in FIG. 4. In this embodiment, three guide pulleys 56 are shown directing the belt 34" through its curved path.

Referring to FIG. 5, the coreless motor 18" is secured to the frame and driving the pinion gear 28". The pinion gear 28" then drives an intermediate spur gear set 58. The intermediate spur gear set 58 drives a spur gear 60 and a bevel gear 62.

Referring to FIG. 6, the sliding door 14" is shown with the lower hinge, i.e., the frame 48 attached thereto. A toothed drive pulley 64 drives the sliding door 14" between its open and closed positions by rotating and forcing itself along the belt 34". The bevel gear 62 rotates a second bevel gear 66 which, in turn, rotates a drive shaft 68 that drives the toothed drive pulley 64.

Referring to FIGS. 7 through 10, a fourth embodiment of the invention 10''' is shown. The belt 34''' is continuous in this embodiment as it was in the first two embodiments. The belt 34''' rolls along pulleys 70 and rollers 72. An attachment clip 74 secures the sliding door 14''' to a single position with respect to the belt 34'''. Therefore, the sliding door 14''' follows the belt 34''' as the belt 34''' moves between its extreme positions.

A frame 48''' positions the pulleys 70 and rollers 72 and is secured to the coreless motor 18'''. The frame 48''' and the coreless motor 18''' are secured together via an intermediate bracket 76 and motor housing 78. The intermediate bracket 76 includes an elongated opening 80 that allows the belt 34''' to move around the coreless motor 18''' and around the frame 48'''.

Figure 10:
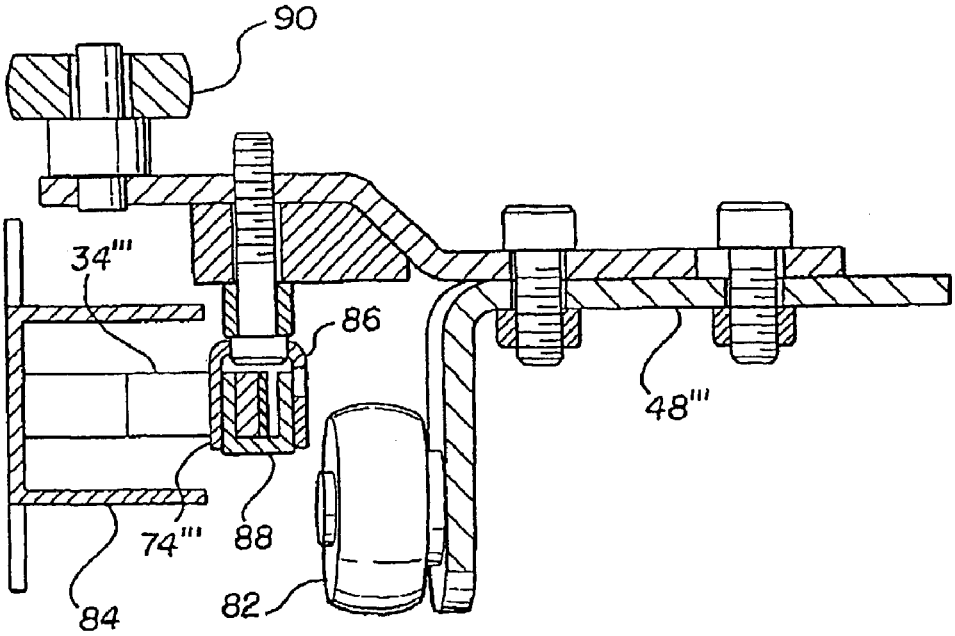
FIG. 10 is a cross-sectional side view of a portion of the frame incorporated into the fourth embodiment of the invention.

FIG. 10 illustrates the belt 34''' and how it is secured to the frame 48'''. A load roller 82 aids in the movement of the sliding door 14'''. The belt 34''' moves through a channel 84 in the frame 48''' as the coreless motor 18''' moves the belt 34''' therearound. The positioning clip 74''' includes an upper clip 86 and a lower clip 88. The positioning clip 74''' clamps on one portion of the belt 34'''. A guide roller 90 moves through the track 50''' to help guide the sliding door 14''' as it moves between the open and closed positions.

In all of the embodiments disclosed herein, the invention 10, 10', 10", 10''' is designed to be modular. More specifically, the automation assembly 10, 10', 10", 10''' is designed to be fit into a motor vehicle that was designed to have the option of whether the sliding door 14 is to be automatically driven or whether the sliding door 14 is to be strictly manually operated. Except for the belt in some of the embodiments, the entire assembly is designed to be secured to the motor vehicle as a single entity. This allows the assembly of the invention 10 to the motor vehicle 12 to be simple.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

We claim:

1. A closure assembly for closing an opening of a motor vehicle, said closure assembly comprising:

a closure panel sized to cover the opening of the motor vehicle;

to endless belt fixedly secured to said closure panel, said belt defining a path;

a coreless motor operatively engaging said belt along said path for moving said belt through said path to move said closure panel; and a tensioning device for absorbing tension in said belt when said closure panel is moved manually, said tensioning device including a first pulley and a second pulley, wherein each of said first and second pulleys operatively engage said belt; and a compression spring extending between said first and second pulleys and biasing said first and second pulleys to each independently pivot with respect to the coreless motor.

2. A closure assembly as set forth in claim 1 wherein said coreless motor includes a pinion gear.

3. A closure assembly as set forth in claim 2 including a drive gear engagable with said pinion gear.

4. A closure assembly as set forth in claim 1 including a sensor for sensing the amount of potential energy stored in said spring, said sensor creating a potential signal.

5. A closure assembly as set forth in claim 4 including an electronic controller electrically connected to said sensor for receiving the potential signal and for operating said coreless motor to minimize the potential energy in said spring.

* * * * *

UNITED STATES PATENT AND TRADEMARK OFFICE

CERTIFICATE OF CORRECTION

PATENT NO. : 7,032,349 B2
APPLICATION NO. : 10/258644
DATED : April 25, 2006
INVENTOR(S) : Oberheide et al.

It is certified that error appears in the above-identified patent and that said Letters Patent is hereby corrected as shown below:

On the Title page item 75, the first named inventor should be:

G. Clarke Oberheide

Signed and Sealed this

Twenty-sixth Day of February, 2008

JON W. DUDAS
*Director of the United States Patent and Trademark Office*